US009297524B2

(12) United States Patent
Swanson

(10) Patent No.: US 9,297,524 B2
(45) Date of Patent: Mar. 29, 2016

(54) STAND ALONE MULTI SPOTLIGHT ELECTRIC FLOOR LAMP

(71) Applicant: Dennis K. Swanson, Woodland Hills, CA (US)

(72) Inventor: Dennis K. Swanson, Woodland Hills, CA (US)

(73) Assignee: LAMPS PLUS, INC., Chatsworth, CA (US)

( * ) Notice: Subject to any disclaimer, the term of this patent is extended or adjusted under 35 U.S.C. 154(b) by 115 days.

(21) Appl. No.: 14/094,983

(22) Filed: Dec. 3, 2013

(65) Prior Publication Data

US 2015/0153012 A1 Jun. 4, 2015

(51) Int. Cl.

| | |
|---|---|
| ***F21S 8/00*** | (2006.01) |
| ***F21V 21/30*** | (2006.01) |
| ***F21S 6/00*** | (2006.01) |

(52) U.S. Cl.
CPC *F21V 21/30* (2013.01); *F21S 6/006* (2013.01)

(58) Field of Classification Search
CPC ..... F21V 21/116; F21V 21/30; F21S 6/006
USPC ..... 362/431
See application file for complete search history.

(56) References Cited

U.S. PATENT DOCUMENTS

| | | | | |
|---|---|---|---|---|
| 2,793,286 | A * | 5/1957 | Stiffel | 362/431 |
| 4,187,531 | A | 2/1980 | Lowell et al. | |
| 5,221,141 | A | 6/1993 | Swanson | |

* cited by examiner

*Primary Examiner* — Anh Mai
*Assistant Examiner* — Hana Featherly
(74) *Attorney, Agent, or Firm* — Novak Druce Connolly Bove + Quigg LLP

(57) ABSTRACT

A stand alone multi-spotlight electric floor lamp having a hollow stem having an axis and carrying electrical wiring to the spotlights wherein the first spotlight is secured to the top of the hollow stem by a pivotal connection permitting the spotlight to be positioned in a plane orthogonal to the axis of the stem and by a swivel connection permitting the spotlight to be positioned in a plane parallel to the axis and two additional spotlights adjustably secured to the stem displaced from the first spotlight.

8 Claims, 4 Drawing Sheets

STAND ALONE MULTI SPOTLIGHT ELECTRIC FLOOR LAMP

BACKGROUND OF THE INVENTION

1. One Field of the Invention

The present invention relates generally to electric lighting apparatus and more particularly to a stand alone electric floor lamp which utilizes multiple spotlights as the source of lighting.

2. Prior Art

Electric lighting apparatus in the form of floor lamps and table lamps is well known. Such lamps generally take the form of a general area lighting device or alternatively a task lighting device. A general area lighting device is one which provides lighting for a predetermined area without particular concern for directing the light for any particular purpose. On the other hand, task lighting focuses the light through the utilization of reflectors for use for a specific purpose such as reading or to highlight a given area to accent some item such as a sculpture, painting or the like. There has been developed electric lighting apparatus in the form of floor lamps which include the combination of general area lighting apparatus and task lighting apparatus attached to a stem positioned on a base. Such devices are generally recognized in the art as torchiere tree lamps and such is shown in prior art U.S. Pat. No. 5,221,141.

While such prior art lighting devices including the combination embodied in the tree torchiere floor lamps function quite well for the specific purpose intended, Applicant is unaware of any floor lamp lighting apparatus which utilizes a multiplicity of spotlights as the source of lighting.

SUMMARY OF THE INVENTION

A stand along multi spotlight electric floor lamp which includes a base member supporting a hollow stem having first and second ends and a central area, a first spotlight secured to the second end of the stem by a pivotal connection and a swivel connection, a second spotlight connected to the stem between the second end and the central area thereof and a third spotlight connected to the stem substantially equidistant from the second spotlight and the second end of the stem.

DETAILED DESCRIPTION OF THE INVENTION

Figure 1:
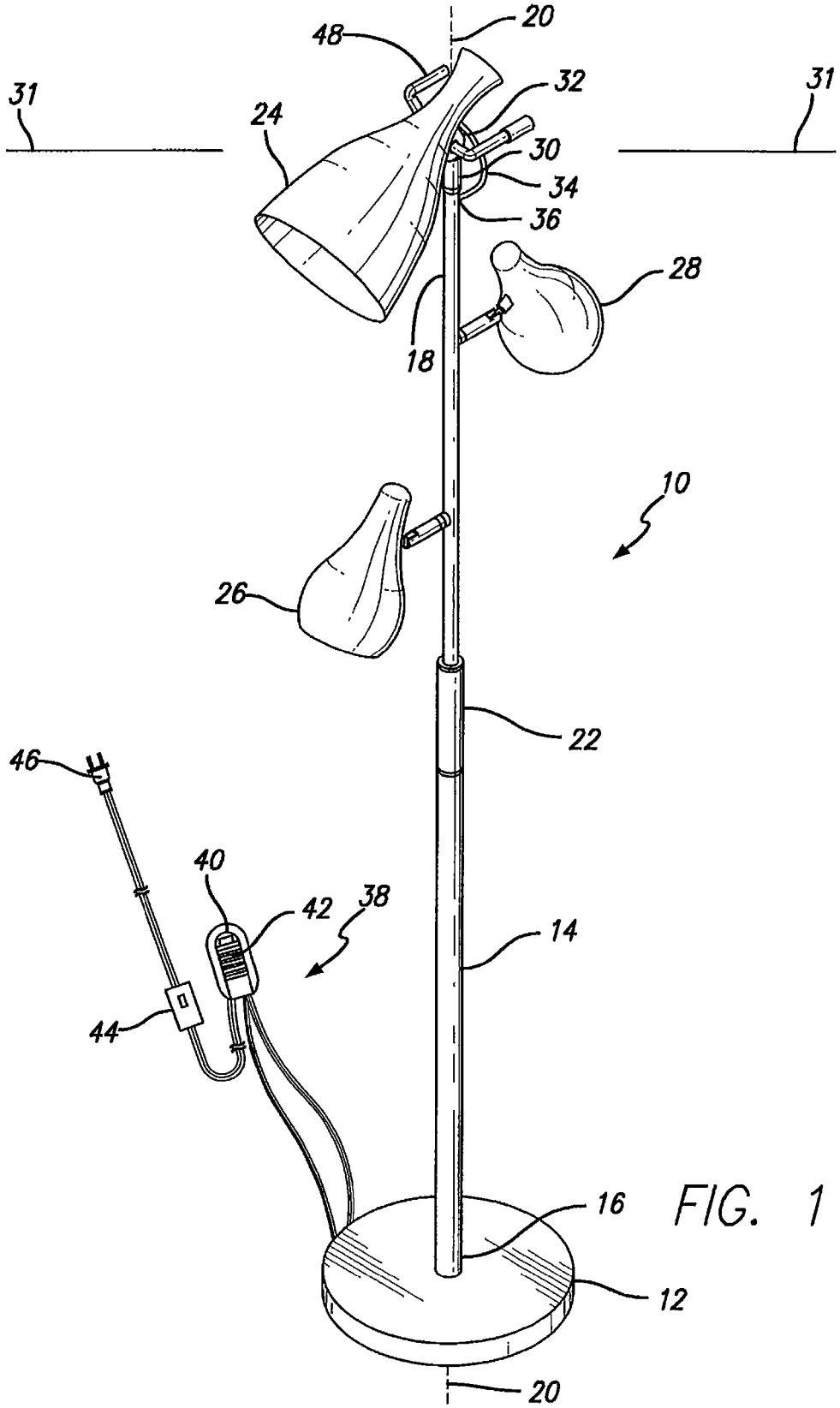
FIG. 1 is a perspective view of a stand along multi spotlight electric floor lamp constructed in accordance with the principles of the present invention.

Referring now to the drawings and more particularly to FIG. 1, there is shown a stand alone multi spotlight electric floor lamp 10 constructed in accordance with the principles of the present invention. As is therein shown, the lamp 10 includes a base 12 which supports a hollow stem 14 which has a first end 16 and a second end 18. The first end 16 is affixed centrally to the base 12 and rises therefrom. The hollow stem 14 includes a longitudinal axis 20 shown by the dashed lines extending from the bottom and top thereof. The stem 14 includes the central portion 22.

A first spotlight 24 is connected to the second end 18 of the stem 14. A second spotlight 26 is connected to the stem 14 between the central area 22 of the stem and the second end 18. A third spotlight 28 is connected substantially equidistance between the second spotlight 26 and the second end 18 of the stem 14.

The first spotlight 24 is connected to the second end 18 of the stem 14 by a pivotal connection 30 to permit the first spotlight to be positioned at points within a plane 31 that is orthogonal to the axis 20 of the stem 14. The first spotlight is also connected to the second end 18 of the stem 14 by a swivel connection 32 to permit the first spotlight to be positioned within a plane (not shown because it would coincide with axis 20) that is parallel to the axis of the stem 14. A flexible conduit 34 is connected to the stem 14 at a point 36 adjacent the second end 18 thereof and extends externally of the stem 14 and is connected to the first spotlight 24. The flexible conduit 34 carries electrical wiring 38 which extends through the hollow stem 14 so that it bypasses the pivotal and swivel connections 30 and 32. The electrical wiring 38 includes an on/off switch 40 and a slide dimmer 42. A limiting switch 44 is also included within the electrical wiring 38 and the electrical wiring terminates in the typical plug 46 which engages a wall socket or the like to provide electrical power to the spotlights 24, 26 and 28.

The first spotlight 24 includes an extension 48 attached externally thereto. The extension 48 permits an operator to manipulate the first spotlight 24 both in a pivotal direction as well as a swivel direction to allow the operator to position the first spotlight 24 to provide illumination as may be desired for any particular purpose. The extension 48 is included to allow the operator to manipulate the first spotlight even if the light has been illuminated for a period of time thus causing the reflector around the lamp to become elevated in temperature.

Figure 2:
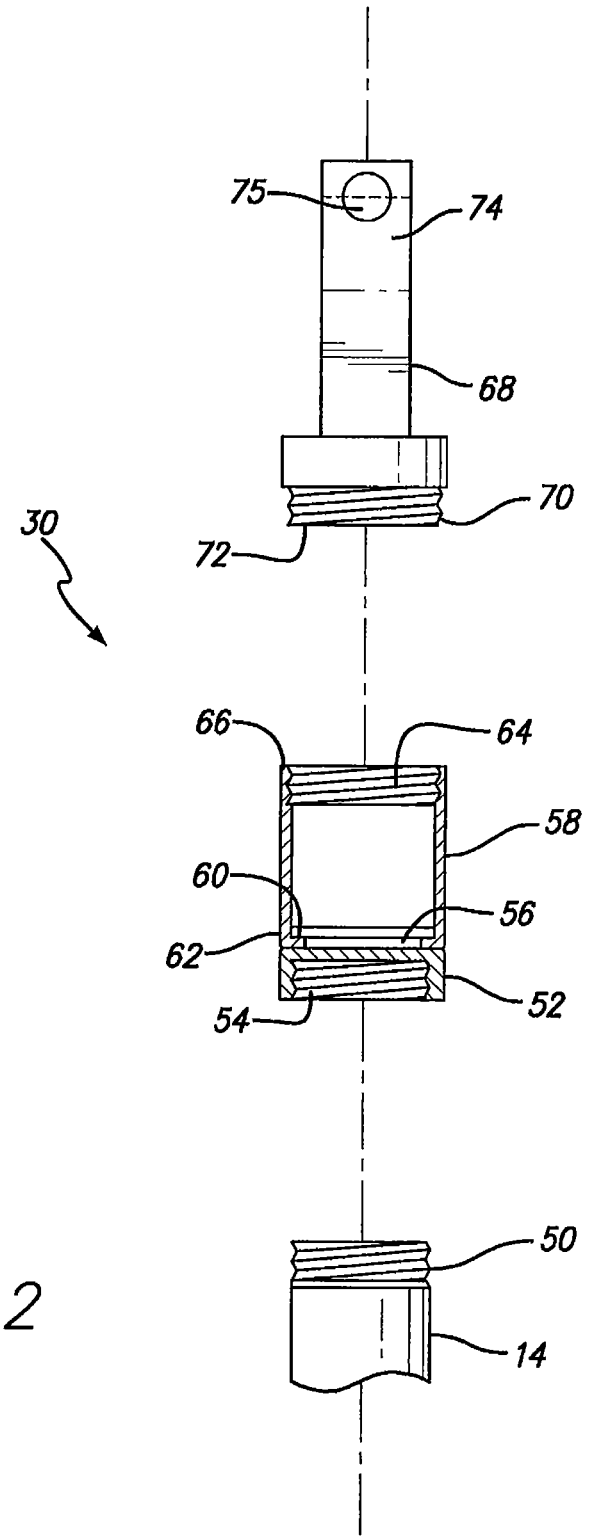
FIG. 2 is an exploded view illustrating the pivotal connection for the first spotlight.

Referring now more particularly to FIG. 2, there is illustrated in an exploded view the pivotal connection 30 and its mode of attachment to the stem 14 and the spotlight 24. As is illustrated, the upper end of the stem 14 defines threads 50 formed externally thereof. A nipple 52 has internal threads 54 formed therein which are adapted to engage the threads 50 to thereby attach the nipple 52 to the end of the hollow stem 14. The nipple 52 defines a groove 56. A tubular member 58 having an inwardly directed lip 60 at a first end 62 thereof is attached to the nipple 52 by having the lip 60 received within the groove 56. The tubular member 58 may then rotate about the axis 20 of the hollow tubular member 14. The tubular member 58 is permitted to rotate less than 360° and more preferably rotates approximately 180°. Appropriate stop members would be positioned within the groove 56 at predetermined positions to control the amount of rotation of the tubular member 58. The tubular member 58 defines internal threads 64 at the upper end 66 thereof. A fitting member 68 has threads 70 at the lower end 72 thereof. The threads 70 are adapted to threadably engage the threads 64 on the tubular member 58. The fitting 68 is decreased in diameter at the upper end 74 thereof for the purpose of receiving an appropriate mechanism to permit attachment of the spotlight 24 thereto. Such will be described in greater detail with respect to FIGS. 3 and 4.

Figure 3:
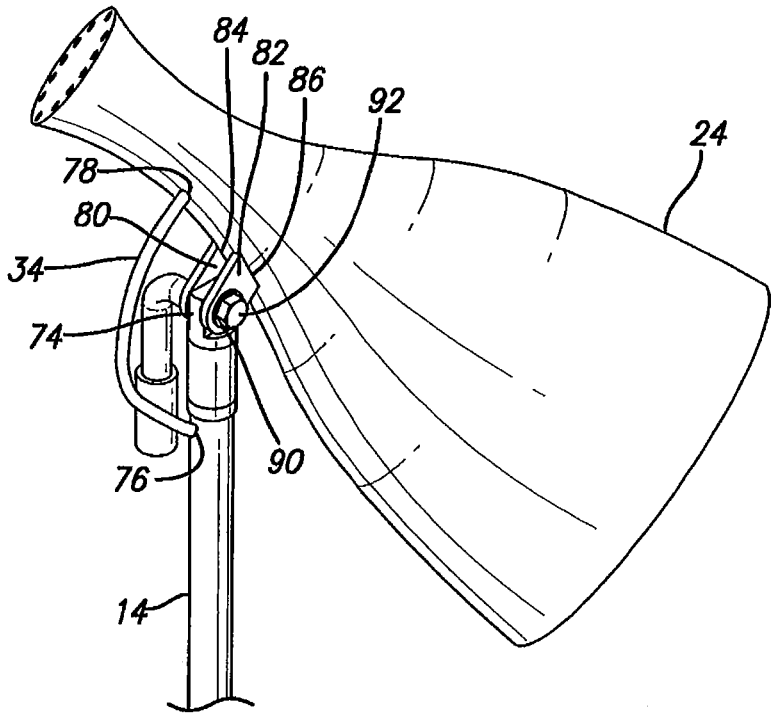
FIG. 3 is a perspective view from one side illustrating the connection of the first spotlight to the stem.
Figure 4:
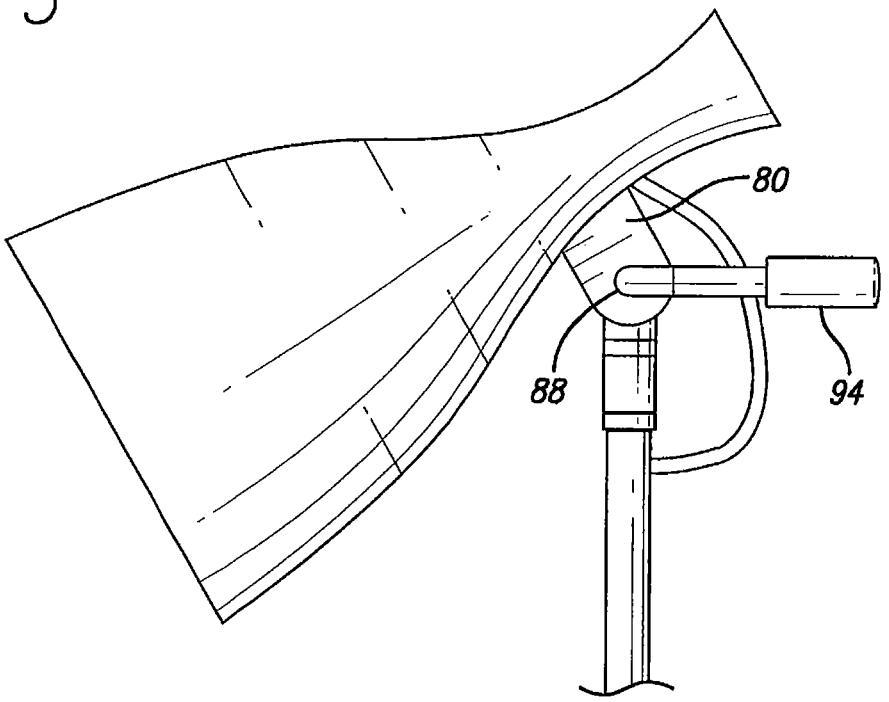
FIG. 4 is a side view taken from the opposite side from that of FIG. 3 illustrating the connection of the first spotlight to the stem.

Referring now more particularly to FIGS. 3 and 4, the flexible conduit 34 is illustrated attached at an opening 76 in the hollow stem 14 and entering the reflector area of the spotlight 24 at an opening 78. As above described, the flexible conduit 34 carries the electrical wiring 38 and bypasses the pivotal and swivel connections attaching the spotlight 24 to the second end of the stem 14. As is shown in FIG. 3, the upper end 74 of the fitting member 68 is flattened so as to be received between a pair of obround members 80 and 82. As is clearly shown, the obround members 80 and 82 are truncated and the truncated ends 84 and 86 thereof are attached to the outer surface of the reflector for the spotlight 24. Each of the obround members defines an opening adjacent the semicircular end thereof as shown at 88 in FIG. 4 for the obround member 80 and at 90 in FIG. 3 for the obround member 82. A pin 92 extends through the openings 88 and 90 in the obround members 80 and 82, respectively, and the opening 75 in the reduced diameter section of the fitting member 68. A clamp 94 is threadably secured to the end of the pin member 92 to cause the obround members 80 and 82 to be drawn together and frictionally secure the spotlight 24 in the desired swivel position once that has been obtained by the operator of the lamp. Although the clamp member 94 is shown as a handle, it should be understood by those skilled in the art that other configurations such as a nut attached to a threaded end of the pin member 92 may be utilized to accomplish the same purpose.

It will be recognized by those skilled in the art that through the combination of the pivotal connection as shown in FIG. 2 attached to the second end of the hollow stem 14 and the obround members 80 and 82, the spotlight 24 may be adjusted pivotally at any position desired within the plane 31 as shown in FIG. 1 and may also be adjusted in a swivel manner about the pin 92 to any position desired within a plane parallel to the axis 20 and when such desired position is attained, the clamp 94 can be tightened to thus secure the spotlight 24 in the desired position to illuminate whatever area or object is desired.

Figure 5:
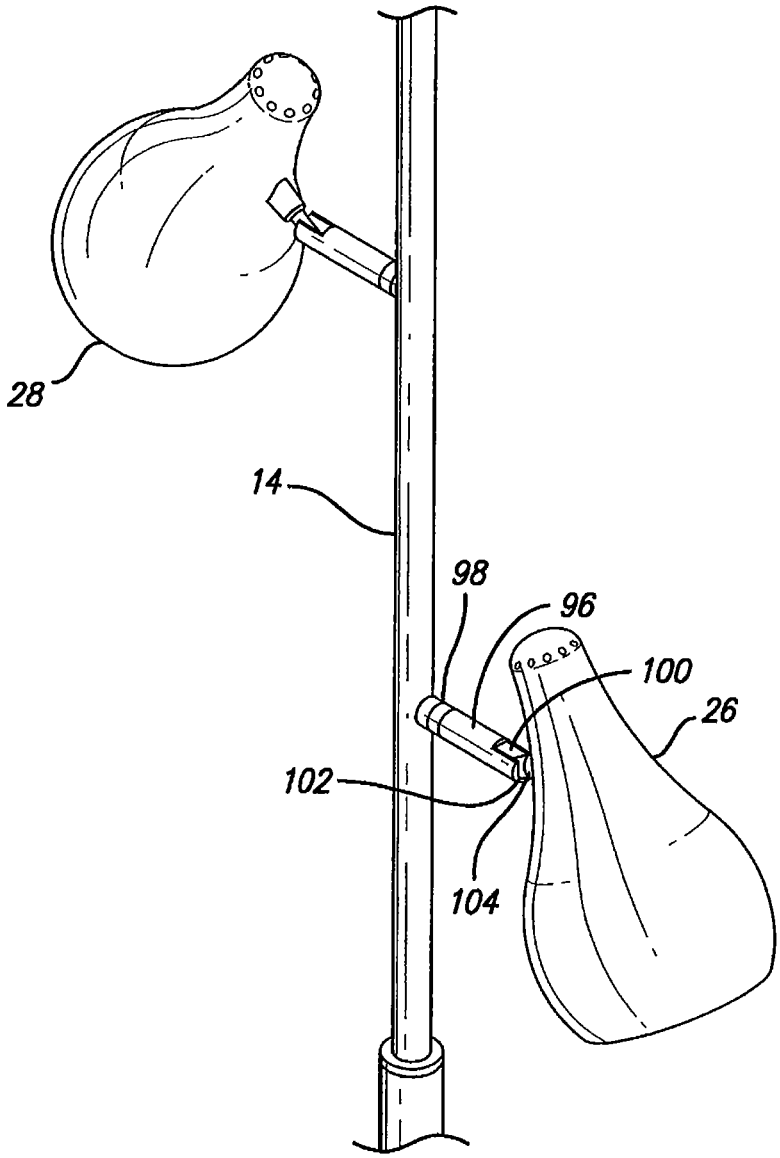
FIG. 5 is a perspective view illustrating the connection of the second and third spotlights to the stem.

By reference now to FIG. 5, there is illustrated a manner in which the spotlights 26 and 28 are attached to the stem 14. As is therein shown, a swivel extension 96 is affixed to a standoff 98 which is permanently attached to the stem 14. The swivel extension is a hollow cylinder having an opening 100 in the wall thereof. The opening 100 receives a ball 102 which is formed on a protrusion 104 which is affixed to the outer surface of the spotlight 26. The electrical wires 38 extend internally of the hollow stem 14 and pass through the standoff and the extension to energize the light contained within the spotlight 26. The spotlight may be rotated about the axis of the protrusion 104 and may be swiveled upwardly and downwardly to provide adjustability for the spotlight 26 so that its light may be directed to any position desired for any particular application. The spotlight 28 is affixed to the stem 14 in an identical manner to that described with respect to spotlight 26.

There has thus been described a stand alone multi-spotlight electric floor lamp in which a spotlight affixed to the top thereof may be adjusted through the utilization of a pivotal connection and a swivel connection to thereby position the spotlight at any point desired within a plane which is orthogonal to the axis of a stem to which the light is affixed and also which may simultaneously be swiveled to any position desired within a plane which is parallel to and incidentally coincides with the axis of the stem to which the lamp is fixed. Such adjustability in both a pivotal and swivel connection provides the ability to position the spotlight to any position desired for any particular application. Two additional spotlights are also disclosed which are attached to the stem displaced from the top thereof to provide additional illumination as may be desired.

What is claimed is:

1. A stand alone multi spotlight electric floor lamp comprising:

(A) a base member for supporting said stand alone floor lamp;

(B) a hollow stem having an axis, first and second ends and a central area, said first end connected to said base member and rising centrally therefrom;

(C) a first spotlight secured to said second end of said stem by the combination of a pivotal connection and a swivel connection, the pivotal connection to permit said first spotlight to be positioned in a plane that is orthogonal to the axis of said stem and the swivel connection to permit said first spotlight to be positioned in a plane that is parallel to the axis of said stem, said swivel connection includes a pair of spaced apart truncated obround members each secured at a truncated end thereof to said first spotlight and each defining an opening adjacent a semicircular end thereof, said second end of said stem being received between said truncated obround members, said second end of said stem defining an opening therethrough aligned with the openings in said truncated obround members, and a pin extending through said openings to permit said first spotlight to swivel;

(D) electrical wiring extending through said hollow stem;

(E) a flexible conduit connected to said stem adjacent said second end thereof and extending externally of said stem to said first spotlight, said flexible conduit carrying said electrical wiring from said hollow stem to said first spotlight to bypass said pivotal and swivel connections;

(F) a second spotlight connected to said stem between said second end and said central area thereof; and (G) a third spotlight connected to said stem substantially equidistance from said second spotlight and said second end of said stem.

2. An electric stand alone floor lamp as defined in claim 1 wherein said pivotal connection includes a rotation coupling secured to said stem at the second end thereof.

3. An electric stand alone floor lamp as defined in claim 2 wherein said stem is threaded adjacent said second end thereof, said rotation coupling includes a nipple defining a groove, said nipple being threadably secured to said threaded end of said stem and a tubular member having an inwardly directed lip at a first end thereof received within said groove, to provide rotation thereof for less than 360°, and threads at a second end thereof.

4. An electric stand alone floor lamp as defined in claim 3 which further includes a fitting member threadably secured to said second end of said tubular member and connected to said first spotlight.

5. An electric stand alone floor lamp as defined in claim 4 wherein said flexible conduit is connected to said stem at a point displaced from said pivotal connection toward said third spotlight.

6. An electric stand alone floor lamp as defined in claim 1 wherein said pin includes a threaded end and which further includes a clamp threadably secured to said pin to secure said first spotlight in a desired position.

7. An electric stand alone floor lamp as defined in claim 6 wherein said clamp includes a handle extending therefrom to be grasped by an operator to permit securing of said first spotlight in said desired position.

8. An electric stand alone floor lamp as defined in claim 1, which further includes an extension from said first spotlight to be used by an operator to adjust the position of said first spotlight both pivotally and swivelly.

* * * * *